US007688300B2

(12) United States Patent
Cheng

(10) Patent No.: US 7,688,300 B2
(45) Date of Patent: Mar. 30, 2010

(54) DRIVING METHOD OF PIXEL ARRAY

(75) Inventor: Kuo-Hsing Cheng, Taipei (TW)

(73) Assignee: Au Optronics Corporation, Hsinchu (TW)

( * ) Notice: Subject to any disclaimer, the term of this patent is extended or adjusted under 35 U.S.C. 154(b) by 453 days.

(21) Appl. No.: 10/709,715

(22) Filed: May 24, 2004

(65) Prior Publication Data

US 2005/0200616 A1 Sep. 15, 2005

(30) Foreign Application Priority Data

Mar. 15, 2004 (TW) ..... 93106803 A

(51) Int. Cl.
*G09G 3/36* (2006.01)

(52) U.S. Cl. ..... 345/96; 345/92; 345/79; 349/144

(58) Field of Classification Search ..... 345/209, 345/96, 54, 694, 92, 55–58, 76–79
See application file for complete search history.

(56) References Cited

U.S. PATENT DOCUMENTS 6,982,690 B2 * 1/2006 Lee et al. ..... 345/87
7,042,437 B2 * 5/2006 Tai et al. ..... 345/103
7,084,849 B2 * 8/2006 Noguchi et al. ..... 345/96
2001/0015716 A1 * 8/2001 Kim ..... 345/96
2003/0146893 A1 * 8/2003 Sawabe ..... 345/89
2005/0083279 A1 * 4/2005 Lee et al. ..... 345/87

* cited by examiner

*Primary Examiner*—Sumati Lefkowitz
*Assistant Examiner*—Seokyun Moon
(74) *Attorney, Agent, or Firm*—Jianq Chyun IP Office

(57) ABSTRACT

A driving method of a pixel array is provided. The driving method is suitable for a pixel array comprising at least one pixel set in each pixel array, wherein at least one pixel set comprises a plurality of pixels. In the driving method, a voltage having substantially same phase is used to drive the pixel electrodes of the pixels in the same pixel set. In addition, voltages with phases substantially opposite to each other are used to drive the pixel electrodes of the pixels in two adjacent pixel sets. Furthermore, a single gate line is used to drive two adjacent pixels in two different pixel sets respectively. In addition, a single gate line is used to drive a first pixel in one of the pixel set and another pixel in an adjacent column of the first pixel, wherein a phase of the voltage of a pixel electrode of the first pixel and a phase of a voltage of a pixel electrode of the other pixel are substantially different.

2 Claims, 4 Drawing Sheets

DRIVING METHOD OF PIXEL ARRAY

CROSS REFERENCE TO RELATED APPLICATIONS

This application claims the priority benefit of Taiwan application serial no. 93106803, filed on Mar. 15, 2004.

BACKGROUND OF INVENTION

1. Field of the Invention

The present invention generally relates to a driving method of liquid crystal display (LCD). More particularly, the present invention relates to a driving method of LCD having high aperture ratio and high stability of displaying gray scale picture.

2. Description of Related Art

In general, conventional liquid crystal display (LCD) may be classified into passive LCD and active LCD according to the driving method thereof. For example, the LCD provided for conventional mobile phone is generally a passive LCD. The conventional passive LCD has the disadvantage of low image,residual shadowing, low contrast and low response speed due to the coupling of the capacitor generated in the passive LCD. In addition, the structure of the passive LCD is more complex than that of the active LCD since the passive LCD is driven by multiplex driving process. Therefore, for a passive LCD, to achieve high resolution, high definition, and full-color is difficult. However, since the cost for manufacturing a passive LCD is low, the passive LCD is generally provided for low stage display device.

Alternatively, an active LCD is generally provided for the thin film transistor (TFT) LCD display device of notebook or monitor. In general, the disadvantage of the passive LCD described above is improved in the active LCD, therefore the image quality and the resolution of the active LCD is much better than that of the passive LCD. An important improvement made to the active LCD is that TFT is provided as a switching device for controlling the rotation and the direction of the liquid crystal molecule. FIG. 1 schematically illustrates a driving circuit of a conventional thin film transistor (TFT). Referring to FIG. 1, the driving circuit includes a data line 103, a gate line 105, a thin film transistor (TFT) 107, a liquid crystal capacitor 109 and a storage capacitor 111. First of all, application of a voltage to each pixel of the liquid crystal molecule in the LCD will be described in the following. In an active LCD, each pixel has a TFT 107. The gate of the TFT 107 is connected to a horizontal gate line such as the gate line 105 shown in FIG. 1. The source of the TFT 107 is connected to a vertical-data line such as the data line 103 shown in FIG. 1. The drain is connected to a pixel electrode. It is noted that, the source and the drain can be applied with the voltages of the data line and the pixel electrode respectively. When the active LCD is operated, the voltages described above do not remain at a constant level but is repeatedly changed in a range of voltage acceptable for the liquid crystal molecule.

Hereinafter, the operation method of the LCD will be described. First of all, a gate line 105 is activated to turn on all the thin film transistors connected to the gate line 105 such as the TFT 107. Next, a corresponding data signal for charging the pixel electrode to an applicable voltage is provided via the data line 103. Thereafter,the TFT 107 is turned off until the gate line 105 is activated subsequently. In the meanwhile, the charge is stored in the liquid crystal capacitor 109. Then, the next gate line is activated for writing the corresponding data signal to the thin film transistors connected to the next gate line. After all the data of the whole frame is written via all the gate lines of the frame gradually. The foremost gate line is activated again to write the signal. Therefore, the cross talk between each pixel is reduced by the simple driving method described above. It is noted that the imaging quality of the LCD is mainly dependent on the electrical characteristics of the TFT such as the turn-off current, the driving current, the parasitic capacitance and the switching speed of the TFT.

The storage capacitor 111 is provided for storing the charge. However,the storage capacitor can also reduce the coupling effect of the voltages applied to the liquid crystal molecule, i.e., the differential voltages between each pixel electrode and the common pixel electrode. When the TFT is turned off, the pixel electrode is not applied with any voltage, i.e., floated. However, at this moment, any variation of voltage around the pixel electrode will be coupled to the pixel electrode via the parasitic capacitance, and thus the voltage level of the pixel electrode is changed. Therefore, the voltage applied to the liquid crystal molecule is influenced. It is noted that an increase in the storage capacitor can reduce the coupling effect between the voltages. However, since at least one pixel electrode of the two pixel electrodes of the storage capacitor is composed of non-transparent metal, the larger the capacitance of the storage capacitor, larger the area of the storage capacitor is. Therefore, the transparent portion of each pixel is reduced, and thus the total light emitting efficiency of the LCD is reduced. Therefore, in order to enhance the aperture ratio of the LCD, the source/drain region of the LCD is generally manufactured by full self alignment process to reduce the parasitic capacitance and the size of the storage capacitor.

Hereinafter, the driving device will be described. FIG. 2 schematically illustrates a conventional driving device of a TFT array using 3N*1driving method. Referring to FIG. 2, the driving device includes pixel G222 for displaying green color, pixel B225 for displaying blue color, pixel R227 for displaying red color, and coupling capacitance 201, 203, 205, 207, 209, 211, 213, 215, 217 and 219 of each pixel. In the 3N*1driving method, the polarity distribution of the voltages of the pixel electrodes of the gate lines in the same horizontal line is +++−−−+++−−−+++−−− . . . In other words, the polarity of the voltages of the pixel electrodes are changed every three pixels due to the three primary colors, green, blue and red. It is noted that, in the 3N*1driving method described above, although the possibility of generation of the traverse electric field is reduced, however, the brightness of the frame is not uniform due to the following reasons.

Referring to FIG. 2, for the pixel G222, since the polarity of voltages of two adjacent data lines are the same, there is no traverse electric field between the two data lines, and thus the aperture ratio is high. However, since the coupling capacitance 205 and 207 may be coupled and an adding effect of the two coupling capacitance is generated, the cross talk therebetween is enhanced. The effect described above may also be generated in the pixel R227.

Referring to FIG. 2, for the pixel B225, since the polarity of voltages of the two adjacent data lines are different, an subtracting effect of the coupling capacitance 209 and 211 is generated corresponding to the pixel B between the two adjacent data lines, and thus the cross talk there-between is reduced.

In summary, in the three pixel of the same frame, the brightness of the pixel B225 is not the same as that of the pixels G222 and R222, therefore the image displayed by the panel is not uniform. Accordingly, although the 3N*1driving method can increase the aperture ratio, however, the displayed image of the frame is not uniform.

SUMMARY OF INVENTION

Therefore, the present invention is directed to a driving method of pixel array having high aperture ratio and high stability of displaying of gray scale picture.

According to an embodiment of the present invention, a driving method of a pixel array is provided. At least one row of the pixel array comprises a plurality of pixel sets, and at least one of the pixel sets comprises a plurality of pixels. The driving method comprises, for example but not limited to, the following steps. First of all, a plurality of voltages having substantially same phase are provided to a plurality of pixel electrodes of the pixels of one of the pixel sets. And at least two voltages having a phase substantially opposite to each other are provided to the pixel electrodes of the pixels of two of the adjacent pixel sets respectively. Next, two adjacent pixels in two of the pixel sets are respectively driven by a single gate line. And a first pixel in one of the pixel set and another pixel in an adjacent column of the first pixel are driven by a single gate line, wherein a phase of a voltage of a pixel electrode of the first pixel and a phase of a voltage of a pixel electrode of the other pixel are substantially different.

In one embodiment of the invention, each of the pixel set comprises three pixels. In another embodiment of the invention, a number of the pixels of each of the pixel set is 3*M, wherein M is a positive integer.

In one embodiment of the invention, another pixel is disposed in an adjacent row of the first pixel.

In addition, according to an embodiment of the present invention, each row of the pixel array comprises at least one pixel set, and at least one of the pixel set comprises a plurality of pixels. In addition, each pixel set corresponds to a data line set having a same pixel number with the pixel set. The driving method comprises, for example but not limited to, the following steps. First of all, whether or not a prior data line and a recent data line belong to the same data line is determined. When the prior data line and the recent data line do not belong to the same data line set, the recent data line is used to drive the pixel disposed after the pixel driven by the prior data line. Alternatively, when the prior data line and the recent data line belong to the same data line set, the recent data line is used to drive one of the pixel disposed in a row apart from the pixel driven by the prior data line.

In one embodiment of the invention, each of the pixel set comprises three pixels. In another embodiment of the invention, a number of the pixels of each of the pixel set is 3*M, wherein M is a positive integer.

Accordingly, in the driving method according to an embodiment of the present invention, since the phases of the voltages of the pixels at both sides of the data line are different, thus a substantial subtracting effect will be generated to the coupling capacitance generated in the pixels. Therefore, the cross talk is reduced. Furthermore, when the amount of cross talk of the green pixel G, blue pixel Band red pixel R are all the same, the brightness uniformity of the image frame and the stability of displaying the gray scale picture are enhanced. In addition, if the phase of the voltage distribution of the pixel electrodes of the pixels in the same horizontal line comprises the distribution +++−−−+++−−−+++−−−, the ratio of traverse electric field is reduced and the aperture ratio is enhanced.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The following drawings illustrate embodiments of the invention and, together with the description, serve to explain the principles of the invention.

DETAILED DESCRIPTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

It is noted that the embodiments of the driving method of the invention described hereinafter comprises TFT LCD. However, in another embodiment of the invention, the driving method of the invention is suitable for any kind of array type display device.

In one embodiment of the invention, the TFT LCD comprises, for example but not limited to, TFT array substrate, color filter array substrate and liquid crystal layer. The TFT array substrate comprises, for example, a plurality of array arranged thin film transistors and the pixels corresponding to the thin film transistors. Each pixel comprises two pixel electrodes, wherein one of the pixel electrode is electrically connected to a common voltage, and the other pixel electrode is connect to a data line. The electrical connection between the other pixel electrode and the data line is controlled by the thin film transistor.

The thin film transistor described above comprises a gate, a drain and a source, and the thin film transistor is adopted as the switching component of the liquid crystal displaying unit. Each pixel may be controlled by four thin film transistors. The TFT LCD described above is generally called an active LCD since the update frequency of image data is high. In the active LCD, the contrast of image is excellent and the blurred image of the frame is reduced. Presently, the active LCD is the LCD display device with the best image quality, however, the cost of the active LCD is high. In general, the image quality of the TFT LCD is dependent on the aperture ratio and the stability of displaying a gray scale picture. The aperture ratio is defined as the transmittance ratio of the LCD panel, i.e., the ratio between the effective transmittance of the light from the LCD panel and the light trapped in the LCD panel. The higher the aperture ratio of the LCD panel is, higher the brightness and lower the power consumption of the LCD panel is. Moreover, the stability of displaying of a gray scale picture is referred to continuous display of a frame from full black to full white. The stability of displaying of a gray scale picture is proportional to the continuity of the variation of the gray scale of the image picture. It is noted that the stability is dependent on the voltage applied to the thin film transistor.

Figure 3:
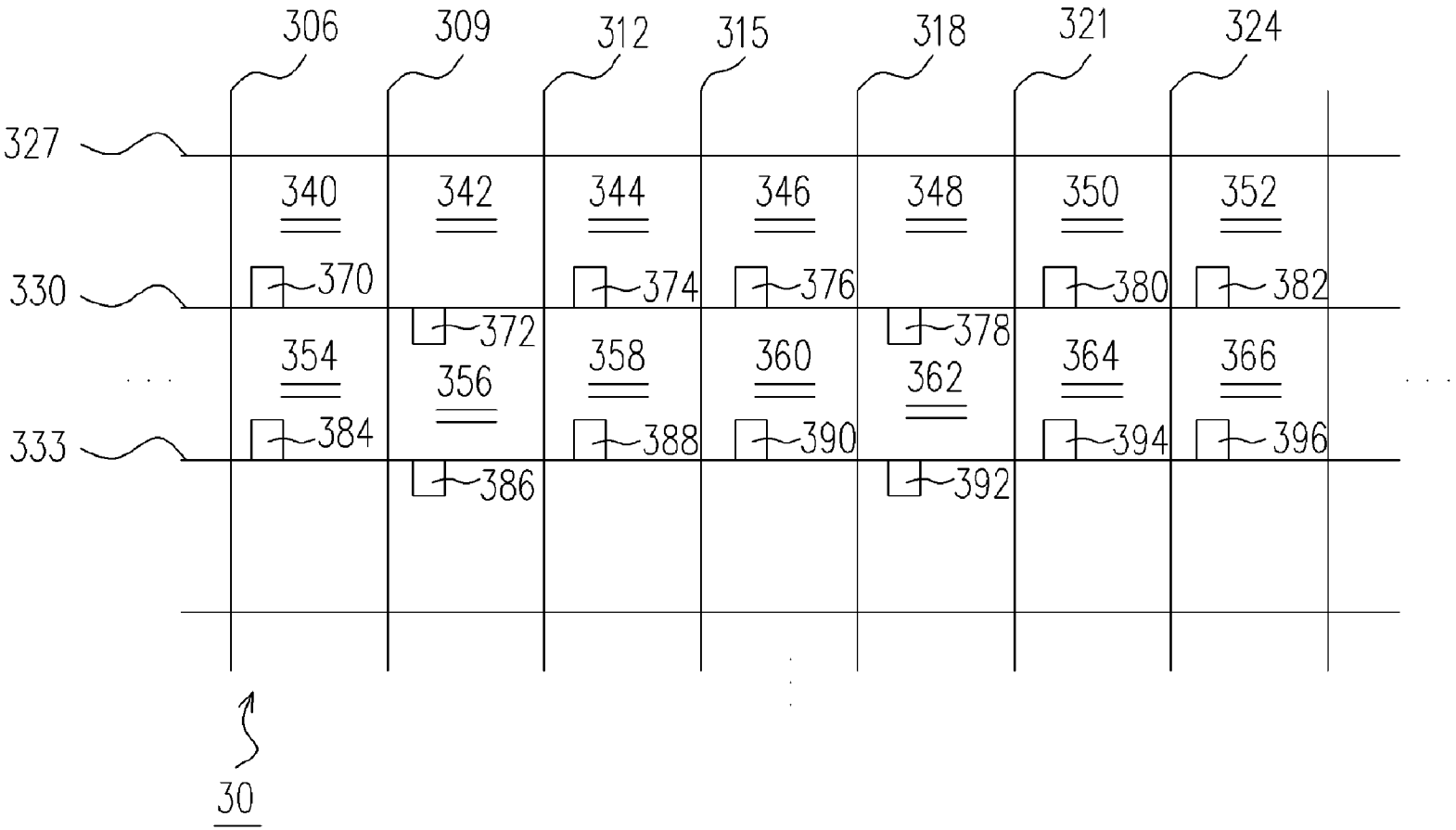
FIG. 3 schematically illustrates a driving circuit of a pixel array for a driving method according to one embodiment of the present invention.

FIG. 3 schematically illustrates a driving circuit of a pixel array for a driving method according to one embodiment of the present invention. Referring to FIG. 3, the pixel array 30 comprises, for example but not limited to, a plurality of data lines 306 to 324, a plurality of gate lines 327 to 333, a plurality of pixels 340 to 366, and a plurality of passing circuits 370 to 396. The passing circuits 370 to 396 is used to apply the voltage of the data lines 306 to 324 to the pixels 340 to 366 according to the voltage of the gate lines 327 to 333 respectively. For example, in one embodiment of the TFT LCD of the invention, the passing circuits 370 to 396 are comprised of thin film transistors. The gate lines 327 to 333 are connected to the gate of the thin film transistors, and the data lines 306 to 324/the pixel electrode of the pixels 340 to 366 are electrically connected to the source/drain of the thin film transistors respectively.

Figure 1:
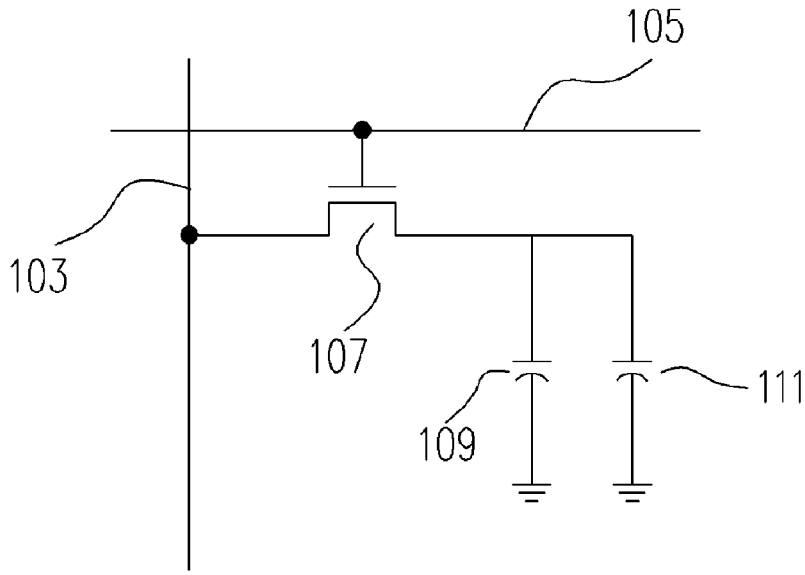
FIG. 1 (PRIOR ART)
FIG. 1 schematically illustrates a driving circuit of a conventional thin film transistor (TFT).
Figure 2:
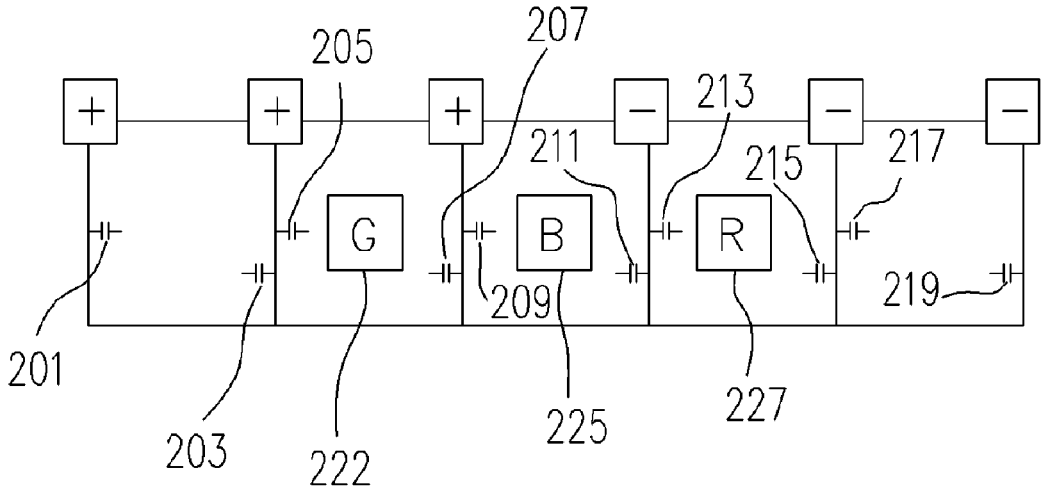
FIG. 2 (PRIOR ART)
FIG. 2 schematically illustrates a conventional driving device of a TFT array using 3N*1driving method.

In addition, in one embodiment of the invention, the distribution of the voltage of the pixel electrode corresponding to the driving method may be described referring to FIG. 2. It is noted that, when the voltage of the data lines 306 to 324 is interlaced by the positive and negative voltages, it is preferable to obtain the same voltage distribution of the pixel electrodes of the pixels shown in FIG. 2 to reduce the cross talk, to maintain the uniformity of the brightness and to achieve the stability of a gray scale picture. In addition, the voltage distribution of the pixel electrodes can also reduce the ratio of the traverse electric field and enhance the aperture ratio. Therefore, the pixels 340 to 366 are divided into a plurality of sets, wherein the voltage of the pixel electrode of each pixel comprises the voltage having substantially the same phase (for example, substantially the same positive or negative phase). In addition, the voltage of the pixel electrode between every adjacent pixels comprise the voltage with a phase substantially opposite to each other (for example, one voltage has a positive phase and the other voltage has negative phase). Therefore, in the present embodiment, the voltage distribution of the pixel electrodes +++−−−+++−−− . . . as shown in FIG. 2 can be provided in the driving method of the invention. It is noted that in the passing circuits 370 to 396, the pixel array 30 is designed to use the same gate line (for example, gate line 330) to drive two adjacent pixels disposed at the intersection of two pixel sets, wherein the two pixels belong to the two pixels respectively. In addition, a gate line is used to drive a first pixel disposed in one pixel set and another pixel disposed in the adjacent column of the first pixel that has a voltage of the pixel electrodes with substantially different phase.

In one embodiment of the invention, the pixels 340 to 344 is referred to as a first pixel set, the pixels 346 to 350 is referred to as a second pixel set, the pixels 354 to 358 is referred to as a third pixel set and the pixels 360 to 364 is referred to as a fourth pixel set. Thus, a first voltage having substantially the same phase (for example, a voltage with positive phase) is used to drive the pixel electrode of each pixel of the first pixel set and the fourth pixel set. In addition, a second voltage having a voltage substantially having a phase opposite compared to the first voltage (for example, a voltage with negative phase) is used to drive the pixel electrode of each pixel of the second pixel set and the third pixel set.

When the inter laced positive and negative voltages are applied as the voltage of the data lines 306 to 324, for example but not limited to, if the voltage is applied starting from the data line 306 is +−+−+−+−, the voltage of the data lines 306 to 324 must be applied to the pixels requiring the corresponding voltage under the control of the gate lines 330. In one embodiment of the present invention, in order to simplify the design of the circuit, two adjacent column of pixels including, for example but not limited to, the first column including the gate lines 327 and 330 and the second column of including the gate lines 330 and 333 are used in the design of the passing circuit. Therefore, the positive voltage of the data line 306 is applied to the pixel electrode of the pixel 340 via the passing circuit 370 controlled by the gate line 330, and thus the voltage applied to the pixel electrode of the pixel 340 is a positive voltage. Next, the voltage of the data line 309 can not be applied to the pixel electrode of the pixel 340 since the voltage of the data line 309 is negative as the voltage required by the pixel 340 is positive. Alternatively, the negative voltage of the data line 309 is applied to the pixel electrode of the pixel 356 adjacent to the pixel 342 at the same column as the voltage required by the pixel 356 is negative.

Next, the positive voltage of the data line 312 will be applied to the pixel electrode of the last pixel of the first pixel set (i.e., the pixel 344) as the voltage of the pixel electrode of the pixel 340 is the same as that of the data line 306. For the first pixel 346 of the second pixel set adjacent to the first pixel set,since the voltage of the pixel electrode of the pixel 346 is supposedly negative voltage, thus the negative voltage of the data line 315 can be directly applied to the pixel 346 via the passing circuit 376. Similarly, the pixels 348 to 366 can be driven by the same driving method of the present invention.

In summary, after the pixels are divided into a plurality of pixel sets, a voltage having substantially same phase is adopted to a pixel electrode of the pixel of the same pixel set. And at least two voltages with phases substantially opposite to each other are applied to the pixel electrodes of the pixels of two of the adjacent pixel sets respectively. In addition, two adjacent pixels in two of the pixel sets are respectively driven by the same gate line. And a first pixel in one of the pixel set and another pixel in an adjacent column of the first pixel are also driven by a same gate line, wherein a phase of a voltage of a pixel electrode of the first pixel and a phase of a voltage of a pixel electrode of the other pixel are substantially different.

In one embodiment of the invention, in order to simplify the design of the circuit and achieve the circuit reproducibility, each pixel set can comprises the same pixels. In another embodiment of the invention, if the number of pixels of each pixel set is 3 or M times of 3 (wherein M is a positive integer), then each pixel set can comprise pixels having colors of red R, green G, and blue B. Therefore, the color distribution of the image of the frame is balanced. In another embodiment of the invention, the number of pixels of each pixel set is not fixed and can be decided according to the requirement of the circuit.

Figure 4:
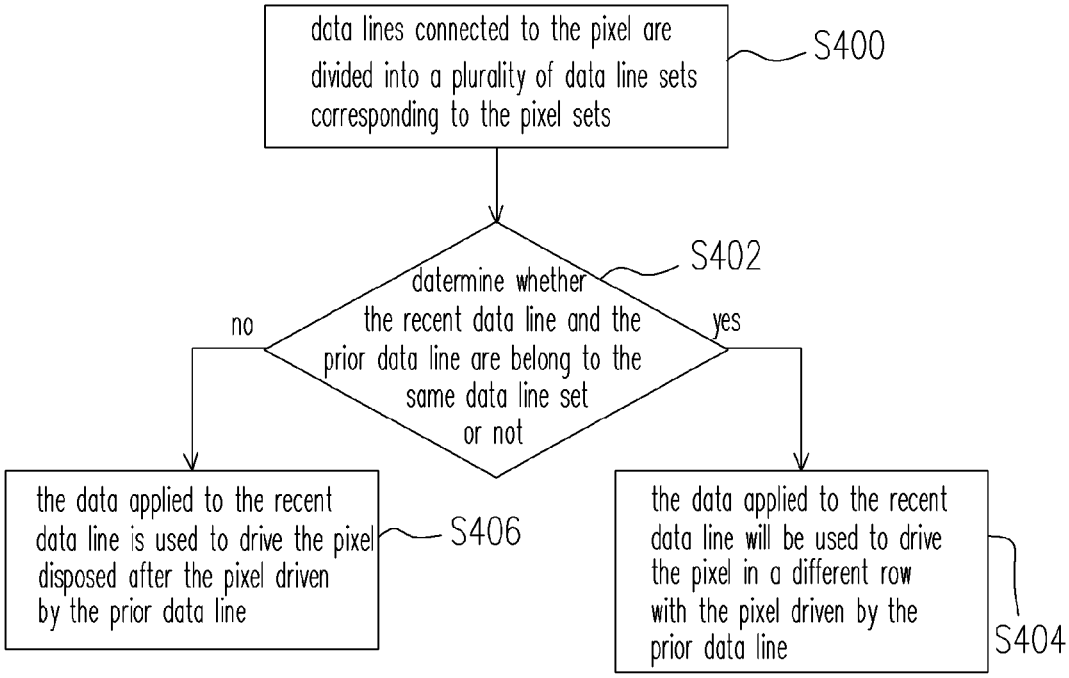
FIG. 4 schematically illustrates a flow chart of the driving method of the pixel array according one embodiment of the present invention.

FIG. 4 schematically illustrates a flow chart of the driving method of the pixel array according one embodiment of the present invention. Referring to FIG. 4, first of all, the pixels in the pixel array is divided into a plurality of pixel sets according to the row of he pixels. In one embodiment of the invention, the pixels can be divided into the pixel sets shown in FIG. 3. However, the embodiments described above can not be used to limit the scope of the invention. In the invention, the pixels disposed in the same row may or may not be divided into the same pixel set. Furthermore, at step 400, the data lines connected to the pixels are also divided into a plurality of data line sets corresponding to the pixel sets. It is noted that, the division of the data lines may be a division in the logic of the circuit, and may not be the division in the circuit.

At step 402, after the division of sets, in the operation of the driving method, the relationship between a recent data line controlled recently and a prior data line disposed prior to the recent data line must be verified. At step 404, if the recent data line and the prior data line belong to the same data line set, the data applied to the recent data line will be used to drive the pixel in a different row with the pixel driven by the prior data line. Alternatively, at step 406, if the recent data line and the prior data line do not belong to the same data line set, the data applied to the recent data line is used to drive the pixel disposed after the pixel driven by the prior data line.

Figure 5:
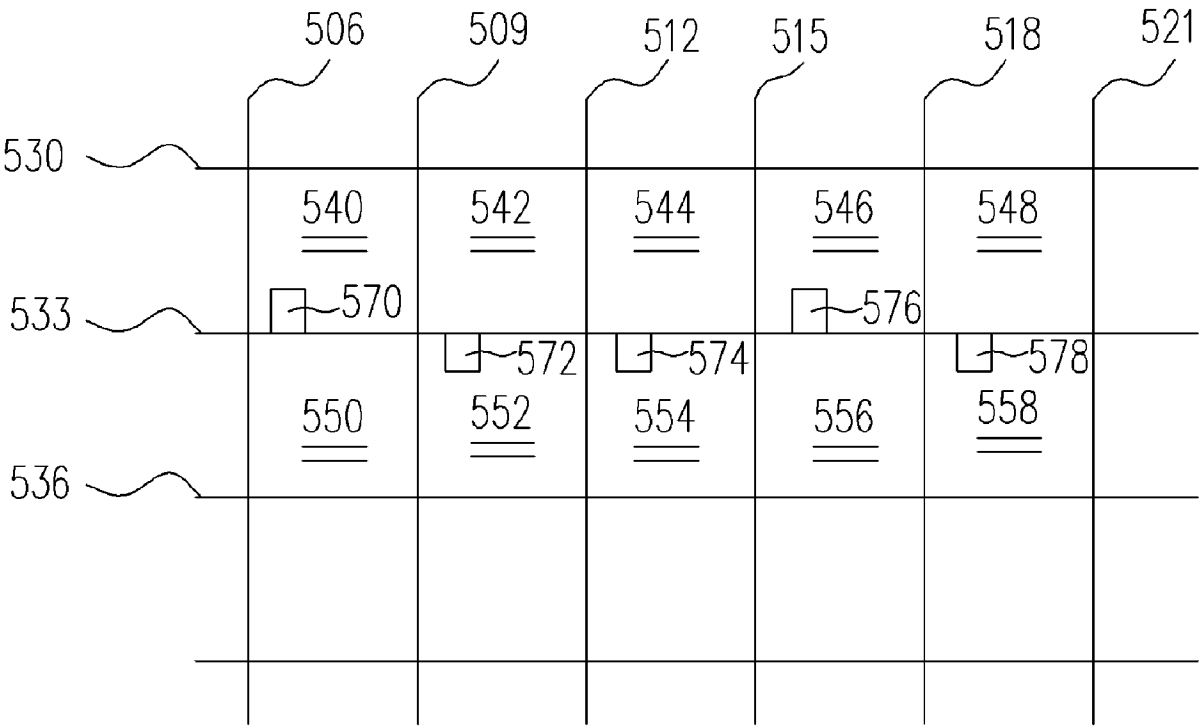
FIG. 5 schematically illustrates a circuit diagram used by the driving method of the pixel array according to one embodiment of the present invention.

FIG. 5 schematically illustrates a circuit diagram used by the driving method of the pixel array according to one embodiment of the present invention. Referring to FIG. 5, for example but not limited to, the first pixel set is composed of the pixels 540 and 542, and the second pixel set is composed of the pixels 544 to 548. Therefore, the corresponding data lines 506 and 509 is referred as the first data line set, and the data lines 512 to 518 are referred as the second data line set. According to the process steps shown in FIG. 4, first of all, the data line 506 is used to drive the pixel 540. Then, the pixel driven by the data line 509 will be verified. Since the data line 509 (referred to as the recent data line) and the data line 506 (referred to as the prior data line) are belong to the same data line set, the data line 509 must be used to drive the pixel not belong to the first pixel set (in the circuit shown in FIG. 5, to drive the pixel 552). Furthermore, the pixel driven by the data line 512 will be verified. Since the data line 512 (referred to as the recent data line) and the data line 509 (referred to as the prior data line) do not belong to the same data line set, the data line 512 will be used to drive the pixel 554 since the pixel 554 is disposed after the pixel driven by the prior data line.

It is noted that, in the embodiments described above, although the passing circuits 370 to 396 and 570 to 578 are provided, however, the passing circuits may also comprise pixels, wherein the phase of the voltage applied to the pixels will change according a corresponding control signal.

In the present invention, in order to increase the brightness and to reduce the power consumption of the LCD, the size of the thin film transistor (TFT) may be reduced and the aperture ratio may be increased. It is noted that, an increase in the mobility of the carrier can increase the driving current of the thin film transistor, therefore, the driving current of the small size thin film transistor is maintained. In addition, an increase in the aperture ratio can be achieved by reducing the parasitic capacitance, the overlap capacitance and the storage capacitance by forming the source/drain region via a full self alignment process. It is noted that the reduction of the brightness of the LCD may be caused by the hysteresis effect generated by the capacitor of the LCD.

Accordingly, in the driving method of the present invention, since the phases of the voltages of the pixels at both sides of the data line are different, thus a substantial subtracting effect will be generated to the coupling capacitance generated in the pixels. Therefore, the cross talk is reduced. Furthermore, when the amount of cross talk of the green pixel G, blue pixel Band red pixel R are all the same, the brightness uniformity of the image frame and the stability of displaying the gray scale picture are enhanced. In addition, if the phase of the voltage distribution of the pixel electrodes of the pixels in the same horizontal line comprises the distribution +++−−−+++−−−+++−−−, the ratio of traverse electric field is reduced and the aperture ratio is enhanced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

The invention claimed is:

1. A pixel array, comprising:

M*N pixels, each row of the pixels having a plurality of pixel sets, wherein the alternating pixel sets j and the (j+1) from the beginning to the end of the $i^{th}$ row of the pixels substantially have different driving polarity, wherein all of the pixels in the $j^{th}$ pixel set of the $i^{th}$ row of the pixels substantially have same driving polarity, and all of the pixels in the $(j+1)^{th}$ pixel set of the $i^{th}$ row of the pixels substantially have same driving polarity, where M, N, i and j are positive integers;

the alternating pixel sets j and the (j+1) from the beginning to the end of the $(i+1)^{th}$ row of the pixels substantially have different driving polarity, wherein all of the pixels in the $j^{th}$ pixel set of the $(i+1)^{th}$ row of the pixels substantially have same driving polarity, and all of the pixels in the $(j+1)^{th}$ pixel set of the $(i+1)^{th}$ row of the pixels substantially have same driving polarity;

the $j^{th}$ pixel set of the $i^{th}$ row of the pixels and the $j^{th}$ pixel set of the $(i+1)^{th}$ row of the pixels substantially have different driving polarity; and the $(j+1)^{th}$ pixel set of the $i^{th}$ row of the pixels and the $(j+1)^{th}$ pixel set of the $(i+1)^{th}$ row of the pixels substantially have different driving polarity;

a plurality of data lines for respectively providing a corresponding pixel voltage, wherein all of the adjacent data lines provide pixel voltages having opposite polarities to each other, respectively; and a plurality of gate lines, wherein $r^{th}$ gate line is used for turning on only all odd pixels in the $j^{th}$ and the $(j+1)^{th}$ pixel sets of the $i^{th}$ row of the pixels and only all even pixels in the $j^{th}$ and the $(j+1)^{th}$ pixel sets of the $(i+1)^{th}$ row of the pixels, where r is a positive integer.

2. The pixel array according to claim 1, wherein each pixel set comprises 3 pixels or a multiple of 3 pixels.

* * * * *